US009169680B2

(12) United States Patent
Kim et al.

(10) Patent No.: US 9,169,680 B2
(45) Date of Patent: Oct. 27, 2015

(54) DOOR HINGE FOR HEAVY EQUIPMENT

(71) Applicant: Hyundai Heavy Industries Co., Ltd., Ulsan (KR)

(72) Inventors: Chang Sik Kim, Gyeongsangbuk-do (KR); Dae Weon Lim, Gyeonggi-do (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 0 days.

(21) Appl. No.: 14/356,407

(22) PCT Filed: Nov. 9, 2012

(86) PCT No.: PCT/KR2012/009463

§ 371 (c)(1),
(2) Date: May 6, 2014

(87) PCT Pub. No.: WO2013/070021

PCT Pub. Date: May 16, 2013

(65) Prior Publication Data

US 2014/0290005 A1 Oct. 2, 2014

(30) Foreign Application Priority Data

Nov. 10, 2011 (KR) ..... 10-2011-0117011
Jul. 6, 2012 (KR) ..... 10-2012-0073627

(51) Int. Cl.
*E05C 17/02* (2006.01)
*E05D 7/00* (2006.01)
(Continued)

(52) U.S. Cl.
CPC ..... *E05D 7/00* (2013.01); *E02F 9/0891* (2013.01); *E05C 17/025* (2013.01); *E05D 3/02* (2013.01);
(Continued)

(58) Field of Classification Search
CPC . E05D 11/10; E05D 11/1007; E05D 11/1014; E05C 17/02; E05C 17/025; E05C 17/04; E05C 17/045; E05C 17/08; E05C 17/085; E05C 17/12; E05C 17/14; E05C 17/16; E05C 17/163; Y10T 16/5404; Y10T 16/54052; Y10T 16/5406; Y10T 16/5407; Y10T 16/544; Y10T 16/304
See application file for complete search history.

(56) References Cited

U.S. PATENT DOCUMENTS 436,546 A * 9/1890 Seng ..... 16/344
649,387 A * 5/1900 Wright ..... 16/344
(Continued)

FOREIGN PATENT DOCUMENTS

BE 458176 A 2/1945
CH 633851 A5 12/1982
(Continued)

OTHER PUBLICATIONS

International Search Report for PCT/KR2012/009463 mailed Mar. 18, 2013.
(Continued)

*Primary Examiner* — Jeffrey O Brien
(74) *Attorney, Agent, or Firm* — Choate, Hall & Stewart, LLP

(57) ABSTRACT

Provided is a door hinge for heavy equipment, including: first plate and a second plate disposed on a hinge shaft of a door of heavy equipment and hinge-coupled to each other to open and close the door; and a stay unit rotatably disposed on the first plate and supporting the second plate when the door is opened to prevent the door from being closed. Thus, according to the present invention, an open state of a door can be maintained by only the stay unit without mounting a bracket by overcoming the limitation that the bracket for mounting a separate door stay must be mounted to a door body in order to maintain the open state of the existing door during opening of the door.

9 Claims, 7 Drawing Sheets

(51) Int. Cl.

| | |
|---|---|
| ***E02F 9/08*** | (2006.01) |
| ***E05D 3/02*** | (2006.01) |
| ***E05C 17/00*** | (2006.01) |
| *E05C 17/04* | (2006.01) |
| *E05C 17/16* | (2006.01) |
| *E05D 11/10* | (2006.01) |

(52) U.S. Cl.

CPC ..... *E05D 11/1007* (2013.01); *E05D 11/1014* (2013.01); *E05C 17/04* (2013.01); *E05C 17/045* (2013.01); *E05C 17/163* (2013.01); *E05D 11/10* (2013.01); *E05D 2003/027* (2013.01); *E05Y 2900/518* (2013.01); *Y10T 16/544* (2015.01); *Y10T 16/5404* (2015.01); *Y10T 16/54052* (2015.01)

(56) References Cited

U.S. PATENT DOCUMENTS

| | | | | | |
|---|---|---|---|---|---|
| 687,320 | A | * | 11/1901 | Kuersten | 16/344 |
| 696,671 | A | * | 4/1902 | Gay | 16/347 |
| 702,304 | A | * | 6/1902 | Hulse et al. | 16/344 |
| 711,715 | A | * | 10/1902 | Clark | 16/344 |
| 2,381,132 | A | * | 8/1945 | Marchand | 16/346 |
| 2,665,448 | A | * | 1/1954 | De Leonardis | 16/345 |
| 2,773,278 | A | * | 12/1956 | Atwood et al. | 16/327 |
| 3,287,050 | A | * | 11/1966 | Ferrante | 292/230 |
| 3,512,820 | A | * | 5/1970 | Barroero | 292/270 |
| 3,980,331 | A | * | 9/1976 | Kennedy et al. | 292/268 |
| 4,181,337 | A | * | 1/1980 | Muller | 292/271 |
| 4,301,570 | A | * | 11/1981 | Thomas | 16/85 |
| 4,620,393 | A | * | 11/1986 | Stafset | 49/394 |
| 4,955,159 | A | * | 9/1990 | Rogers | 49/161 |
| 7,793,894 | B1 | * | 9/2010 | Olsen et al. | 248/74.2 |
| 8,347,554 | B2 | * | 1/2013 | Uto et al. | 49/381 |
| 8,549,711 | B2 | * | 10/2013 | Apostoloff | 16/375 |
| 2007/0029821 | A1 | * | 2/2007 | Maeda | 292/338 |
| 2009/0084619 | A1 | * | 4/2009 | Lin | 180/69.2 |
| 2009/0241289 | A1 | | 10/2009 | Choi et al. | |
| 2010/0066104 | A1 | * | 3/2010 | Critchley | 292/216 |
| 2011/0126469 | A1 | * | 6/2011 | Uto et al. | 49/397 |
| 2011/0185637 | A1 | * | 8/2011 | Uto et al. | 49/399 |
| 2012/0086223 | A1 | * | 4/2012 | Golden | 292/303 |
| 2012/0192492 | A1 | * | 8/2012 | Cutting | 49/394 |
| 2012/0248797 | A1 | * | 10/2012 | Caliguri et al. | 292/251.5 |
| 2013/0145695 | A1 | * | 6/2013 | Wach et al. | 49/381 |
| 2013/0145696 | A1 | * | 6/2013 | Wach et al. | 49/386 |

FOREIGN PATENT DOCUMENTS

| | | | |
|---|---|---|---|
| CN | 87214290 | U | 5/1988 |
| CN | 87213477 | U | 12/1988 |
| CN | 2056688 | U | 5/1990 |
| CN | 2175814 | Y | 8/1994 |
| DE | 1153500 | B | 8/1963 |
| JP | 09-315347 | A | 12/1997 |
| JP | 2010-059638 | A | 3/2010 |
| JP | 2010-158969 | A | 7/2010 |
| KR | 20-2010-0005674 | U | 6/2010 |

OTHER PUBLICATIONS

Extended European Search Report, 12847645.4, 5 pages (Apr. 15, 2015).

* cited by examiner

DOOR HINGE FOR HEAVY EQUIPMENT

CROSS-REFERENCE TO RELATED APPLICATIONS

This application is the U.S. national stage application of International Patent Application No. PCT/KR2012/009463, filed Nov. 9, 2012, which claims priority to Korean Application Nos. 10-2011-0117011, filed Nov. 10, 2011, and 10-2012-0073627, filed Jul. 6, 2012, the entire contents of each of which are incorporated herein by reference in their entirety.

TECHNICAL FIELD

The present invention relates to a door hinge for heavy equipment, and more specifically, to a door hinge for heavy equipment which can overcome the limitation that a bracket for mounting a separate door stay must be mounted to a door body in order to maintain an open state of an existing door during opening of the door, thereby enabling the open state of the door to be maintained without mounting the bracket.

BACKGROUND ART

In general, a door hinge refers to a component used in a hinged door that opens or closes while rotating on a certain axis and is also called a hinge. This door hinge has been widely used in everyday life of an office, home and the like as well as industrial settings in which heavy equipment is used.

FIG. 1 is a perspective view showing a state in which a typical door for heavy equipment is opened by a hinge, and the door hinge 1 for heavy equipment is provided at a hinge shaft of a door 2 for heavy equipment to enable the door 2 to open or close.

The door hinge 1 for heavy equipment is composed of a pair of plates 10, 20 whose one end is rotatably connected as illustrated in FIG. 2, thereby rotatably supporting the iron door 2 and functioning to openably and closably connect the door 2 to a main body of the heavy equipment.

However, in a case where the aforesaid door for heavy equipment, namely, the iron door, is open with regard to the main body of the heavy equipment, a phenomenon that the door closes by itself due to a weight, wind or the like occurs, and accordingly, there is generated an inconvenience that the open door must be supported by a separate device when a worker rides in the heavy equipment or would like to replace or repair components of the heavy equipment.

That is, in order to maintain the iron door for the heavy equipment in the open state, a separate door stay device is needed.

In order to mount the separate door stay according to a conventional art, one end of the door stay must be fixed to a rotating door frame, and another end thereof must be connected by mounting a bracket to a main body of an excavator for connection of the door stay, but when the bracket cannot be mounted to the main body of the heavy equipment due to space restriction, it is problematic in that it is difficult to mount the door stay device.

DISCLOSURE OF INVENTION

Technical Problem

The present invention has been made keeping in mind the above problems occurring in the conventional art, and an object of the present invention is to provide a door hinge for heavy equipment which can overcome the limitation that a bracket for mounting a separate door stay must be mounted to a door body in order to maintain an open state of an existing door during opening of the door, thereby enabling the open state of the door to be maintained without mounting the bracket.

The technical problems to be solved by the present invention are not limited to the technical problems described above, and other technical problems which are not mentioned may be clearly understood by those having ordinary skill in the art to which the present invention pertains based on the following described contents.

Solution to Problem

In order to accomplish the above object, the present invention provides a door hinge for heave equipment, including: a first plate and a second plate that are disposed on a hinge shaft of a door of heavy equipment and are hinge-coupled to each other to open and close the door; and a stay unit that is rotatably disposed on the first plate and supports the second plate when the door is opened, thereby preventing the door from being closed.

Also, the stay unit may include: a stay bar that is rotated on a plane parallel to the first plate; a rotating axis that is disposed at one end of the stay bar and is connected to one side of the first plate; and a guide boss that is disposed on one surface of the stay bar to guide or restrict a rotating orbit of the stay bar.

Also, a bearing may be interposed into a coupling portion between the guide boss and the stay bar.

Also, a guide groove for guiding or restricting an orbit of the guide boss may be formed in the first plate.

Meanwhile, the door hinge for heavy equipment may further include: a fixing unit that is disposed on the first plate and is configured to fix the stay unit by which support for the second plate is released.

Also, the stay unit is disposed adjacent to the guide boss and is detachably attached to the fixing unit, thereby further including a fixing boss for fixing the stay bar at a predetermined position.

Also, a bearing may be interposed into a coupling portion between the fixing boss and the stay bar.

Also, the fixing unit may include the fixing unit comprises: a support portion that protrudes from one end of the first plate and is formed to be bent to one surface of the first plate; and a snap-fit attaching/detaching portion that is disposed at the support portion to be snap-fit coupled to the fixing boss.

Also, the snap-fit attaching/detaching portion may be made of an elastic material.

Also, a surface of the snap-fit attaching/detaching portion may be coated with a synthetic resin.

Advantageous Effects of Invention

According to the present invention, it is advantageous in that an open state of a door can be maintained by only a stay unit without mounting a bracket by overcoming the limitation that the bracket for mounting a separate door stay must be mounted to a door body in order to maintain an open state of an existing door during opening of the door.

Furthermore, since a fixing unit for fixing the stay unit by which an open state of the door is released is provided, it is advantageous in that noise and vibration generated from the stay unit during the driving of heavy equipment can be reduced.

MODE FOR THE INVENTION

Figure 1:
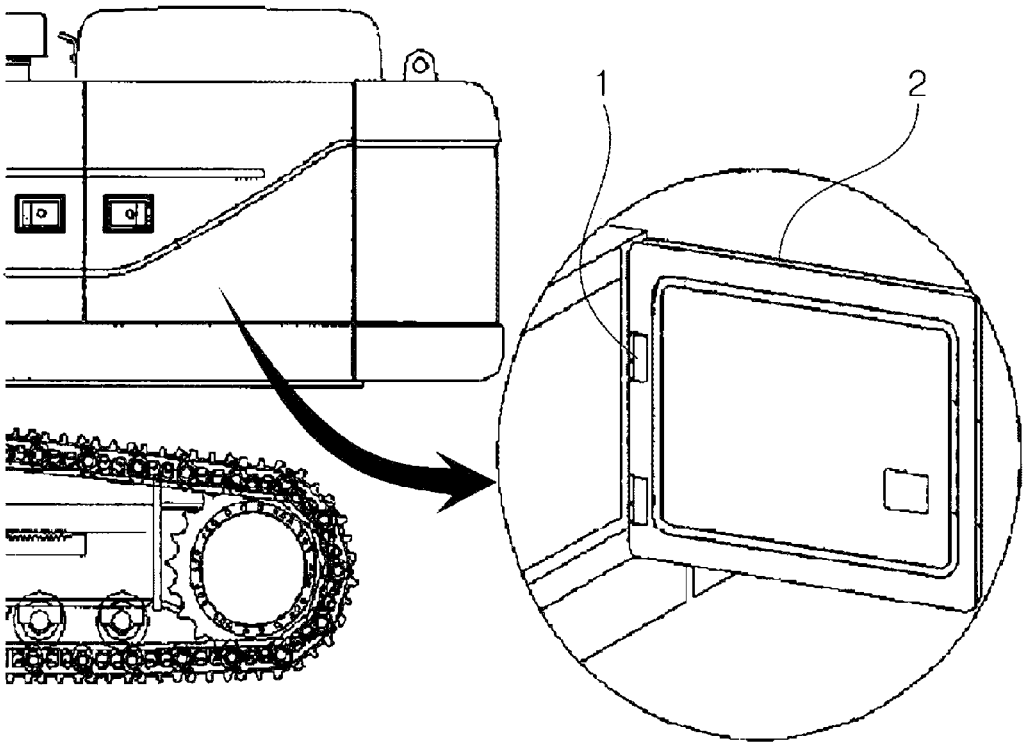
Fig. 1 PRIOR ART
FIG. 1 is a perspective view showing a state in which a typical door for heavy equipment is opened by a hinge.
Figure 2:
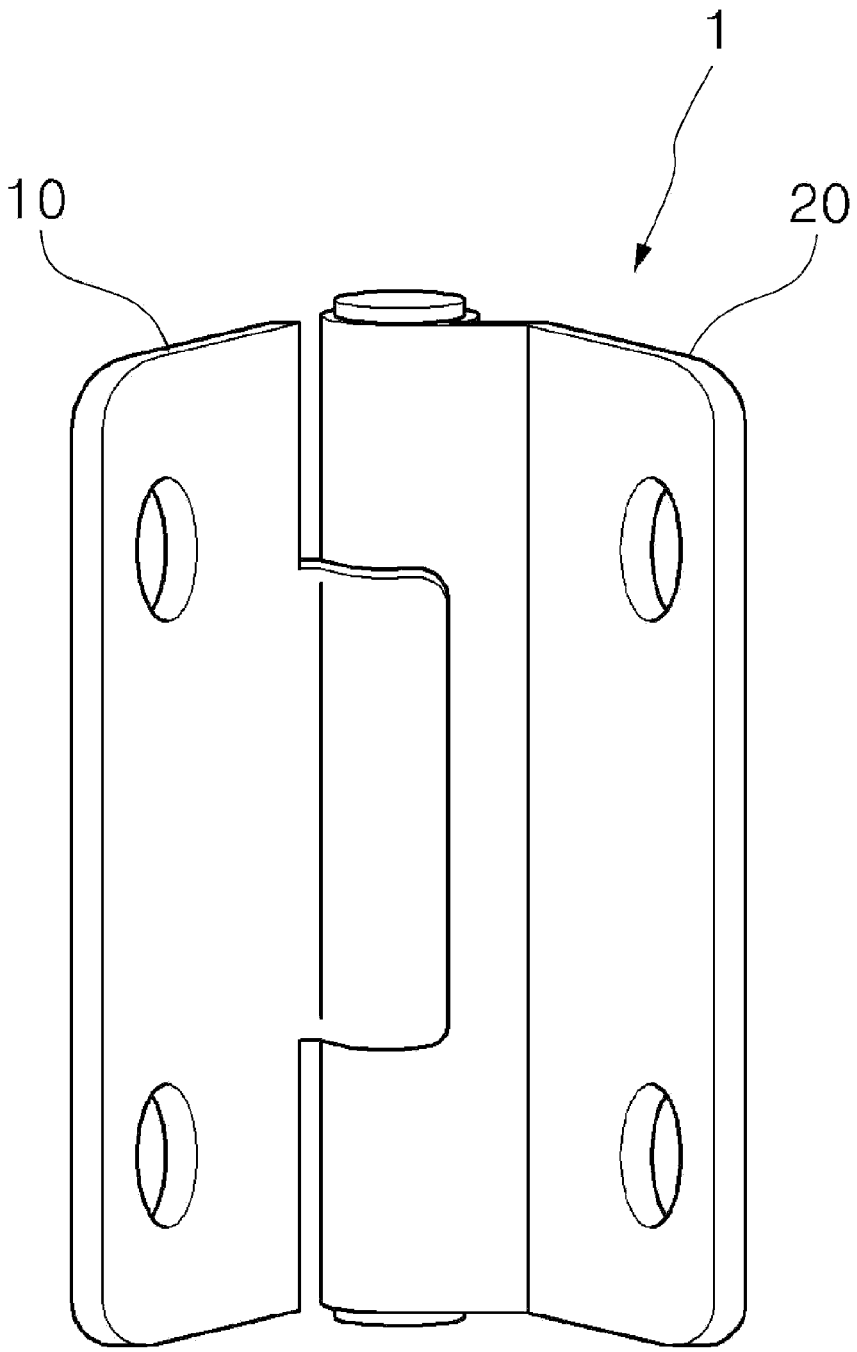
Fig. 2 PRIOR ART
FIG. 2 is a perspective view showing a conventional door hinge for heavy equipment.

Hereinafter, embodiments of the present invention will be described in detail with reference to the accompanying drawings. It should be understood that a size or shape of the elements illustrated in the drawings may be exaggeratedly drawn to more clearly and conveniently explain the present invention. Furthermore, the terms specifically defined in consideration of the configuration and operation of the present invention may be changed depending on the intention or practice of a user and an operator. The terms should be defined based on all contents in the specification. The present invention may be embodied in different forms and should not be construed as limited to the embodiments set forth herein. Those having ordinary skill in the art who understand the present invention could easily embody different embodiments which belong to the scope of the present invention.

Figure 3:
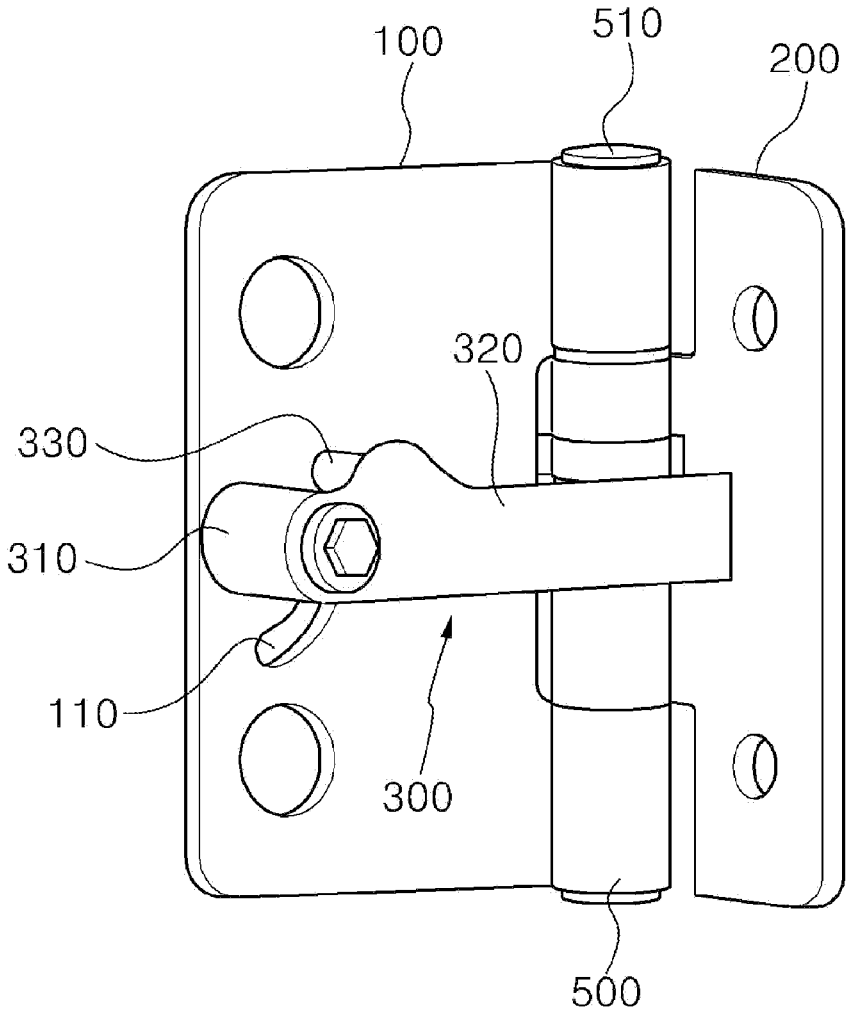
FIG. 3 is a perspective view showing a door hinge for heavy equipment according to an embodiment of the present invention.
Figure 4:
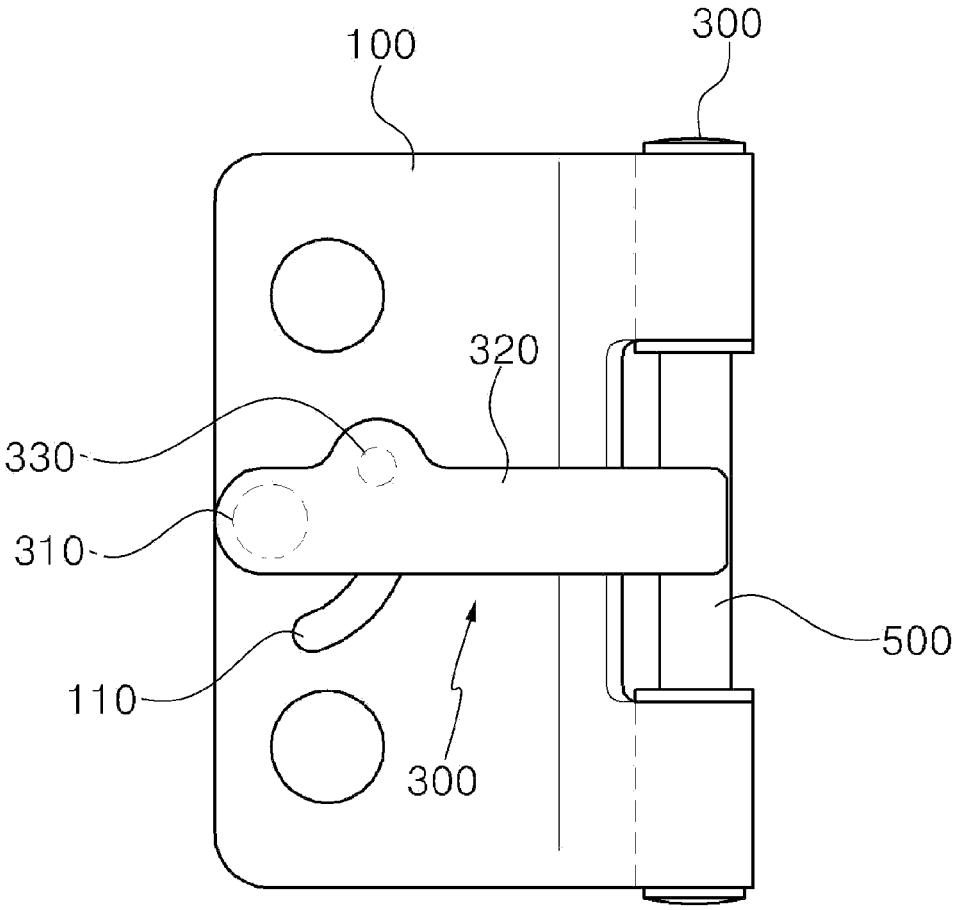
FIG. 4 is a front view showing the door hinge for heavy equipment according to the embodiment of the present invention.
Figure 5:
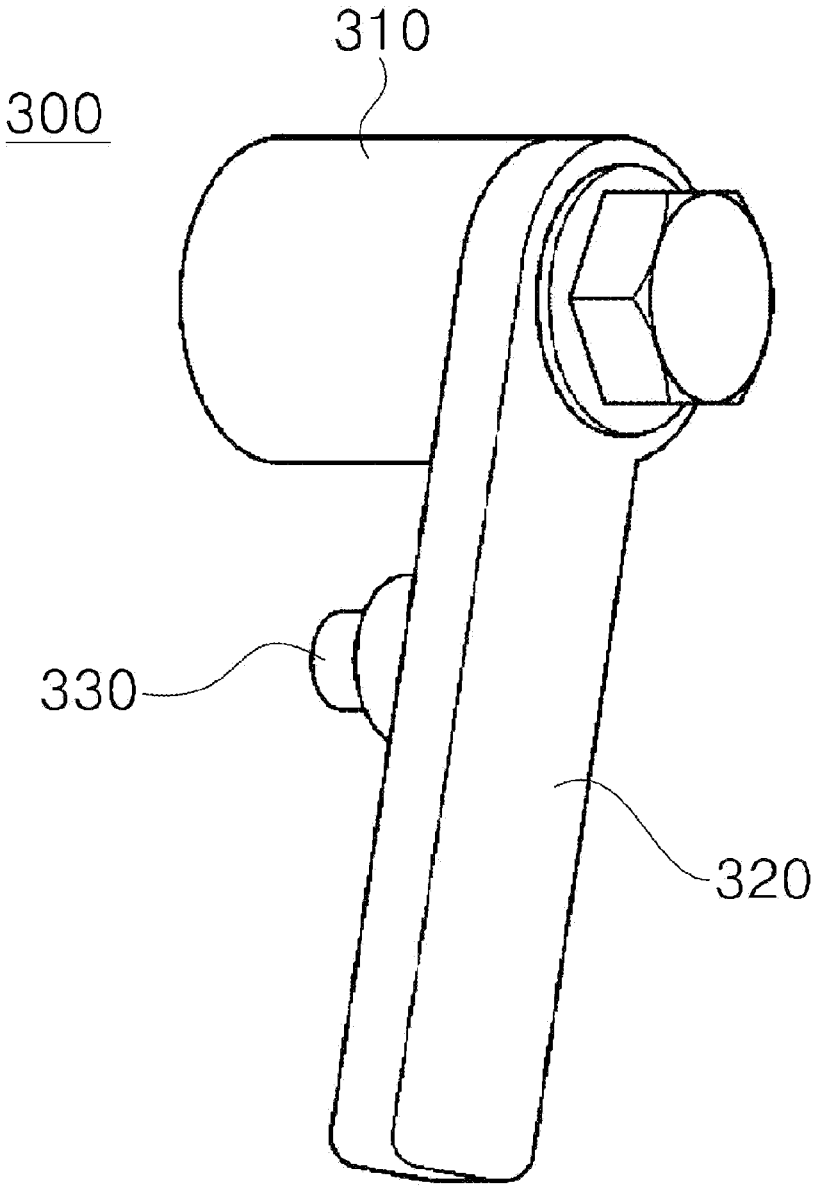
FIG. 5 is a perspective view showing a stay unit of the door hinge for heavy equipment according to the embodiment of the present invention.

FIGS. 3 and 4 are a perspective view and a front view showing a door hinge for heavy equipment according to an embodiment of the present invention and FIG. 5 is a perspective view showing a stay unit of the door hinge for heavy equipment according to the embodiment of the present invention. The detailed configurations, structures and operation processes of the door hinge for heavy equipment will be hereinafter described with reference to FIGS. 3 to 5.

As illustrated in FIGS. 3 and 4, the door hinge for heavy equipment is disposed on a hinge shaft of a door for the heavy equipment to open or close the door and includes a first plate 100, a second plate 200, a stay unit 300, and the like.

The first plate 100 and the second plate 200 are disposed on the hinge shaft of the door for the heavy equipment and are hinge-coupled to each other to open or close the door. That is, the first plate 100 and the second plate are connected on the hinge shaft 500, and this connection method corresponds to a method typically used in the relevant technical field and is not specially limited.

Here, a configuration of the hinge shaft 500 corresponds to a configuration which is typically used in the relevant technical field, and is not specially limited. It is preferable that an end protection cap 510 for protecting the coupling of the hinge shaft 500, the first plate 100 and the second plate 200 be disposed at both ends of the hinge shaft 500.

Furthermore, one of the first plate 100 and the second plate is coupled to the door and another one is coupled to a main body of the heavy equipment so that the door is rotated to open or close an opening portion of the heavy equipment. Meanwhile, configurations of the first plate 100 and the second plate 200 correspond also to configurations which are typically used in the relevant technical field, and are not specially limited.

Meanwhile, referring to FIG. 3, the first plate 100 configured to mount the stay unit 300 which will be explained below may be formed to have a width larger than that of the second plate. That is, according to the present embodiment of the present invention, the stay unit 300 is mounted to one side of the first plate 100, and since the first plate 100 and the second plate 200 are folded when closing of the door 2, in order to prevent the stay unit 300 from being interfered with the second plate 200, it is preferable that the width of the first plate 100 be formed larger than that of the second plate 200 as much as a portion to which the stay unit 300 is mounted.

The stay unit 300 is rotatably disposed at one side of the first plate and supports the second plate 200 when the door is opened so that the door can be prevented from being closed due to a weight of the door itself or inertia resulting from movement of the heavy equipment.

The stay unit 300 includes a stay bar 320, a rotating axis 310, a guide boss 330, and the like.

The stay bar 320 is formed in a rectangular panel-like shape and is rotated on the plane parallel to the first plate 100. That is, one end of the stay bar 320 is coupled to one side of the first plate 100 by the rotating axis 310 which will be explained below, and another end of the stay bar supports the second plate 200 in a contacting state, and as a result, when the door is opened, the door can be prevented from being closed.

The rotating axis 310 is disposed at one end of the stay bar 320 to be coupled to one side of the first plate 100, thereby enabling the stay bar 320 to be rotated.

The guide boss 300 is disposed on one surface of the stay bar 320 to guide or restrict a rotating orbit of the stay bar 320. As illustrated in FIG. 4, a guide groove 110 is formed in the first plate 100, and the guide boss 330 is inserted into the guide groove 110 so that an orbit of the guide boss 330 is guided or restricted, thereby guiding or restricting the rotating orbit of the stay bar 320.

In consideration of the rotating orbit of the stay bar 320 which is rotated on the first plate 100, it is preferable that the guide groove 110 be formed in a curved arc shape, and it is preferable that an arc length of the guide groove 110 be formed to an extent so that another end of the stay bar 320 can support the second plate 200 when the door is opened, and a fixing boss 340 which will be explained below can be fixed to a fixing unit 400 when the opening of the door is released.

Meanwhile, a bearing (not drawn) may be interposed into a coupling portion between the guide boss 330 and the stay bar 320 so that the guide boss 330 can be easily moved along the guide groove 110 when rotating of the stay bar 320.

The stay unit 300 may be made of a steel material in terms of strength and durability, but if a material is not defective for fixing the first plate 100 and the second plate 200 and for maintaining the fixation in a state of the door being opened, the material can be used in the stay unit.

Hereinafter, a process in which the door hinge for the heavy equipment according to the present embodiment of the invention is operated upon opening or closing of the door will be described. In opening or closing the door of the heavy equipment, the door hinge is rotated on the hinge shaft, and accordingly, the door enables an opening portion of a main body of an excavator to open or close.

Referring to FIG. 3, when the door enables the opening portion of the main body of the excavator to open, the stay bar 320 of the stay unit 300 is rotated on the rotating axis 310, and supports the second plate so that an open state of the door can be maintained. At this time, the guide boss 330 coupled to the stay unit 300 is moved along the guide groove 110 according to rotation of the stay unit 300 so that the rotation of the stay unit 300 can be smoothly performed and the occurrence of a clearance can be controlled.

Figure 6:
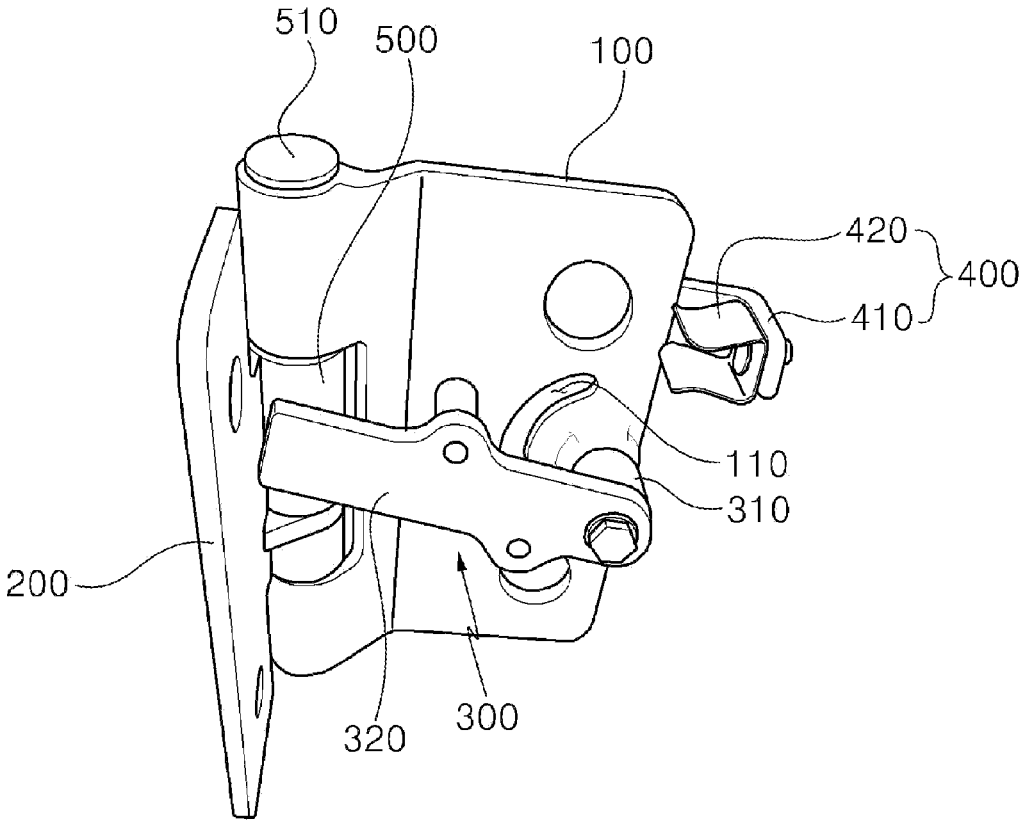
FIGS. 6 and 7 are perspective views showing a door hinge for heavy equipment according to other embodiments of the present invention.
Figure 7:
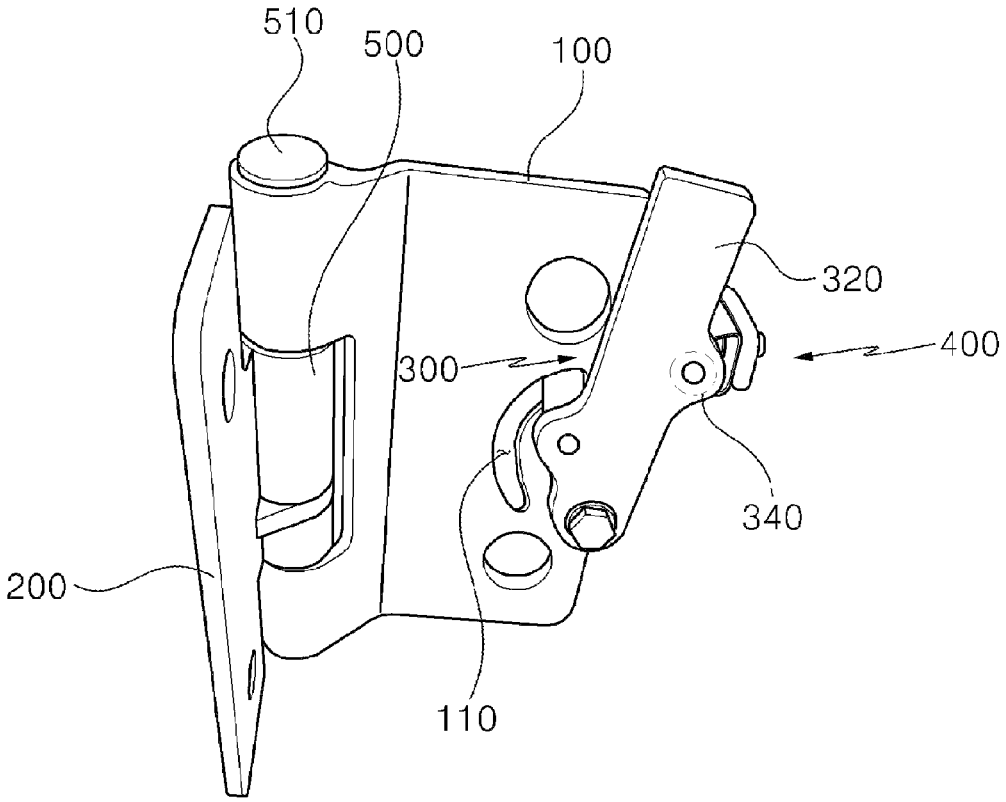

FIGS. 6 and 7 are perspective views showing a door hinge for heavy equipment according to other embodiments of the present invention. The detailed configurations, structures and operational processes of the door hinge for heavy equipment will be described with reference to FIGS. 6 and 7. The description on the same configurations as the door hinge for the heavy equipment according to the aforesaid embodiment of the present invention will be omitted.

As illustrated in FIGS. 6 and 7, the door hinge for the heavy equipment includes the fixing unit 400, wherein the fixing unit 400 is disposed on the first plate 100 to fix the fixing boss of the stay unit 300 by which support for the second plate 200 is released.

The fixing unit 400 includes a support portion 420 and a snap-fit attaching/detaching portion 410, wherein the support portion 420 protrudes from one end of the first plate 100 and is formed to be bent to one surface of the first plate. That is, the support portion 420 protrudes in a Korean character 'ㄱ'-like shape at one side of the first plate 100 and supports the snap-fit attaching/detaching portion 410.

The snap-fit attaching/detaching portion 410 is disposed on the support portion 420 to be snap-fit coupled to the fixing boss 340. The snap-fit attaching/detaching portion 410 is made of an elastic material, and the fixing boss 340 is fixed by a pair of hook portions at both sides. That is, the pair of hook portions of the snap-fit attaching/detaching portion 410 enables an inlet of the snap-fit attaching/detaching portion to extend when the fixing boss 340 is inserted, and enables the inlet to be reduced after the fixing boss 340 has been inserted, thereby enabling the fixing boss 340 to be fixed to the snap-fit attaching/detaching portion 410.

Meanwhile, a surface of the snap-fit attaching/detaching portion 410 may be coated with a synthetic resin so that the fixing boss 340 can be easily inserted into the snap-fit attaching/detaching portion 410.

As described above, the fixing boss 340 is disposed adjacent to the guide boss 330 and is detachably attached to the fixing unit 400, thereby enabling the stay bar 320 to be fixed at a predetermined position.

That is, referring to FIG. 7, when the stay bar 320 enables the support for the second plate 200 to be released in order to open the door, the fixing boss 340 is fixed to the fixing unit 400 so that noise or vibration can be prevented from being generated due to oscillation of the stay bar 320 upon driving of the heavy equipment and durability can be also improved because the oscillation of the stay bar 320 is prevented.

Furthermore, a bearing (not drawn) may be interposed into a coupling portion between the fixing boss 340 and the stay bar 320 so that the fixing boss 340 can be easily fixedly inserted into the fixing unit 400.

Hereinafter, a process in which the door hinge for the heavy equipment according to the present embodiment of the invention is operated upon opening or closing of the door will be described.

Referring to FIG. 6, when the door enables the opening portion of the main body of the excavator to open, the stay bar 320 of the stay unit 300 is rotated on the rotating axis 310, and supports the second plate 200 so that an open state of the door can be maintained. At this time, the guide boss 330 coupled to the stay unit 300 is moved along the guide groove 110 according to rotation of the stay unit 300, thereby enabling the rotation of the stay unit 300 to be performed smoothly and the occurrence of a clearance to be controlled.

Furthermore, referring to FIG. 7, when the door enables the opening portion of the main body of the excavator to close, the stay bar 320 of the stay unit 300 is rotated on the rotating axis 310 so that the open state can be released. At this time, the fixing boss 340 is fixedly inserted into the fixing unit 400, thereby enabling noise and vibration to be prevented from being generated due to oscillation of the stay bar 320.

The foregoing is illustrative of embodiments and is not to be construed as limiting thereof. Although a few embodiments have been described, those skilled in the art will readily appreciate that many modifications are possible in embodiments without materially departing from the novel teachings and advantages. Accordingly, all such modifications are intended to be included within the scope of this inventive concept as defined in the claims. In the claims, means-plus-function clauses are intended to cover the structures described herein as performing the recited function, and not only structural equivalents but also equivalent structures.

What is claimed is:

1. A door hinge for heavy equipment, comprising: a first plate and a second plate that are disposed on a hinge shaft of a door of heavy equipment and are hinge-coupled to each other to open and close the door; the first plate having a first face parallel to the hinge shaft and the second plate having a second face parallel to the hinge shaft; and a stay unit that is rotatably disposed on the first plate and supports the second plate when the door is opened to prevent the door from being closed;

wherein the stay unit comprises: a stay bar that is rotated on a plane parallel to the first face of the first plate; a rotating axis perpendicular to the hinge shaft; the rotating axis is disposed at one end of the stay bar and is connected to the first face of the first plate; and a guide boss that is disposed on one surface of the stay bar to guide or restrict a rotating orbit of the stay bar.

2. The door hinge of claim 1, wherein a bearing is interposed into a coupling portion between the guide boss and the stay bar.

3. The door hinge of claim 1, wherein a guide groove for guiding or restricting an orbit of the guide boss is formed in the first plate.

4. The door hinge of claim 1, further comprising a fixing unit disposed on the first plate and configured to fix the stay unit by which support for the second plate is released.

5. The door hinge of claim 4, wherein the stay unit is disposed adjacent to the guide boss and is detachably attached to the fixing unit, thereby further comprising a fixing boss for fixing the stay bar at a predetermined position.

6. The door hinge of claim 5, wherein a bearing is interposed into a coupling portion between the fixing boss and the stay bar.

7. The door hinge of claim 5, wherein the fixing unit comprises: a support portion that protrudes from one end of the first plate and is formed to be bent to one surface of the first plate; and a snap-fit attaching/detaching portion that is disposed at the support portion to be snap-fit coupled to the fixing boss.

8. The door hinge of claim 7, wherein the snap-fit attaching/detaching portion is made of an elastic material.

9. The door hinge of claim 7, wherein a surface of the snap-fit attaching/detaching portion is coated with a synthetic resin.

* * * * *